US008896206B1

(12) United States Patent
Fan

(10) Patent No.: US 8,896,206 B1
(45) Date of Patent: Nov. 25, 2014

(54) THREE-DIMENSIONAL LAMP TUBE

(71) Applicant: Cai Cheng Technology Co., Ltd., Hsinchu (TW)

(72) Inventor: Kuei-Liang Fan, Hsinchu (TW)

(73) Assignee: Cai Cheng Technology Co., Ltd., Hsinchu (TW)

( * ) Notice: Subject to any disclaimer, the term of this patent is extended or adjusted under 35 U.S.C. 154(b) by 0 days.

(21) Appl. No.: 13/924,921

(22) Filed: Jun. 24, 2013

(51) Int. Cl.
*H01J 17/16* (2012.01)
*H01J 61/30* (2006.01)
*H01J 61/32* (2006.01)

(52) U.S. Cl.
CPC ..... *H01J 61/327* (2013.01)
USPC ..... 313/634; 313/317

(58) Field of Classification Search
USPC ..... 313/634, 631, 632, 574, 573, 317
See application file for complete search history.

(56) References Cited

U.S. PATENT DOCUMENTS

| | | | | |
|---|---|---|---|---|
| 4,746,835 | A * | 5/1988 | Imamura et al. | 313/493 |
| 4,853,591 | A * | 8/1989 | Klein et al. | 313/493 |
| 5,844,357 | A * | 12/1998 | Iida et al. | 313/493 |
| 2003/0168983 | A1* | 9/2003 | Oga et al. | 313/634 |
| 2006/0138931 | A1* | 6/2006 | He | 313/493 |
| 2007/0063656 | A1* | 3/2007 | Wursching et al. | 313/634 |
| 2009/0278439 | A1* | 11/2009 | Liang | 313/493 |
| 2011/0050073 | A1* | 3/2011 | Huang | 313/46 |

* cited by examiner

*Primary Examiner* — Nimeshkumar Patel
*Assistant Examiner* — Glenn Zimmerman
(74) *Attorney, Agent, or Firm* — Jackson IPG PLLC

(57) ABSTRACT

A three-dimensional (3D) lamp tube includes a first electrode terminal and a second electrode terminal formed at both ends of the 3D lamp tube respectively, and a plurality of straight tube sections disposed between the first and second electrode terminals, and a bent section is disposed between two straight tube sections, and the first electrode terminal is extended upwardly from one of the straight tube sections and through the plurality of bent sections, and bent along an external periphery of the first electrode terminal to produce an arc 3D structure, and finally extended downwardly from another straight tube section to the second electrode terminal, so that the space and volume occupied by the 3D lamp tube can be concentrated to improve the drawback of the conventional lamp tube that can only be applied to a large planar lamp socket and to replace the conventional light bulb.

4 Claims, 12 Drawing Sheets

THREE-DIMENSIONAL LAMP TUBE

FIELD OF THE INVENTION

The present invention relates to a three-dimensional (3D) lamp tube, in particular to the 3D lamp tube capable of improving the light emitting efficiency and product life.

BACKGROUND OF THE INVENTION

Household lamps have been changed from fluorescent lamp tubes with larger volume and higher power consumption to fluorescent light bulbs with a smaller size. In general, the fluorescent light bulbs can overcome the problems of the large volume and high power consumption, yet the brightness is insufficient. To overcome the brightness issue while maintaining the size of the light bulbs that can be plugged into a socket, it is necessary to improve the arrangement and density of the fluorescent lamps.

Although the brightness can be enhanced by the arrangement and density of the fluorescent lamps, yet the power consumption will be increased. Further, people pay more attention to the concept of environmental protection in recent years, efforts and capitals are invested to find substitutes for the conventional illumination equipments of such high power consumption. At present, may manufacturers start developing low-power cold cathode tube lamps with a brightness not less that that of the conventional fluorescent lamps while achieving the power-saving requirement.

With reference to FIG. 1, if a general cold cathode tube lamp is applied in a lamp base, the cold cathode tube lamp is installed with a plurality of cold cathode tubes 11, and a lamp base is disposed at the bottom of the U-shaped cold cathode tube 11 and corresponding to a general socket. Since each U-shaped cold cathode tube 11 of this design must be connected independently with an internal circuit board, therefore the circuits installed in the cold cathode tube lamp are usually too complicated. To overcome the issue of the complicated circuit, another cold cathode tube lamp with continuous bent cold cathode tubes is provided.

With reference to FIG. 2 for a second conventional cold cathode tube lamp, a general cold cathode tube is bent and formed in the conventional cold cathode tube lamp to reduce the number of required circuit contacts while maintaining the illumination area of the cold cathode tube as shown in the figure, and this kind of cold cathode tubes has a plurality of continuous repeatedly-bent bends 12, so that the original number of required cold cathode tubes can be reduced and simplified to a single planar bent cold cathode tube. However, the cold cathode tubes of this design can be in a planar shape only. If such cold cathode tube is installed onto a lamp base, the corresponding lamp base must be in a strip form, and thus the volume of the lamp base may become too large. When the cold cathode tube is in a planar form, the density of the light will be scattered and the illumination will be lowered.

With reference to FIG. 3 for a third conventional cold cathode tube lamp, the conventional cold cathode tube lamp has a positioning base 13, a control circuit board (not shown in the figure) installed therein and having an electrode terminal 14 coupled to the bottom of the positioning base 13 and corresponding to a traditional lamp socket, a plurality of cold cathode tube lamps 15 coupled to the top of the positioning base 13, and each of the cold cathode tube lamps 15 is a lamp tube extended upwardly from the control circuit board and continuously and repeatedly bent, and finally extended downwardly to another electrode terminal of the control circuit board and bent along the external periphery of the top of the positioning base to form an arc structure.

However, this type of conventional cold cathode tube lamps 15 can be only bent along the external periphery of the top of the positioning base into an arc structure. Although it can cover a light emitting angle of 360 degrees, the illumination effect is poor and a raster phenomenon may occur.

SUMMARY OF THE INVENTION

In view of the aforementioned drawbacks of the prior art, it is a primary objective of the present invention to provide.

To achieve the aforementioned objective, the present invention provides a 3D lamp tube, particularly the 3D lamp tube capable of improving the light emission efficiency and product life effectively.

To achieve the foregoing objective, the present invention provides a 3D lamp tube comprising a first electrode terminal and a second electrode terminal formed at both ends of the 3D lamp tube respectively, and a plurality of straight tube sections disposed between the first and second electrode terminals, and a bent section is disposed between two straight tube sections, and the first electrode terminal is extended upwardly from one of the straight tube sections and through the plurality of bent sections, and bent along an external periphery of the first electrode terminal to produce an arc 3D structure, and finally extended downwardly from another straight tube section to the second electrode terminal. The straight tube sections of the bent 3D lamp tube will not block each other, so as to maximize the light emission efficiency.

Particularly, the 3D lamp tube of the present invention can concentrate the space and volume occupied by the 3D lamp tube to improve the drawback of the conventional lamp tube that can only be applied to a large planar lamp socket and to replace the conventional light bulb. In addition, the light of the straight tube section at the top of the first electrode terminal can supplement the light of other straight tube sections without producing a raster phenomenon.

To achieve the aforementioned objective, the 3D lamp tube is installed at a positioning base coupled to a traditional lamp socket, and the positioning base has a control circuit board installed therein, and the control circuit board has a connector coupled to the bottom of the positioning base and corresponding to the structure of the traditional lamp socket, and the control circuit board is electrically coupled to the first and second electrode terminals of the 3D lamp tube.

Wherein, the positioning base further includes a translucent cover covered onto the 3D lamp tube.

To achieve the aforementioned objective, the bent section is bent and formed at the 3D lamp tube at a high temperature by using a tool.

DESCRIPTION OF THE PREFERRED EMBODIMENTS

The aforementioned and other objectives and advantages of the present invention will become clearer in light of the following detailed description of an illustrative embodiment of this invention described in connection with the drawings. It is intended that the embodiments and drawings disclosed herein are to be considered illustrative rather than restrictive.

Figure 1:
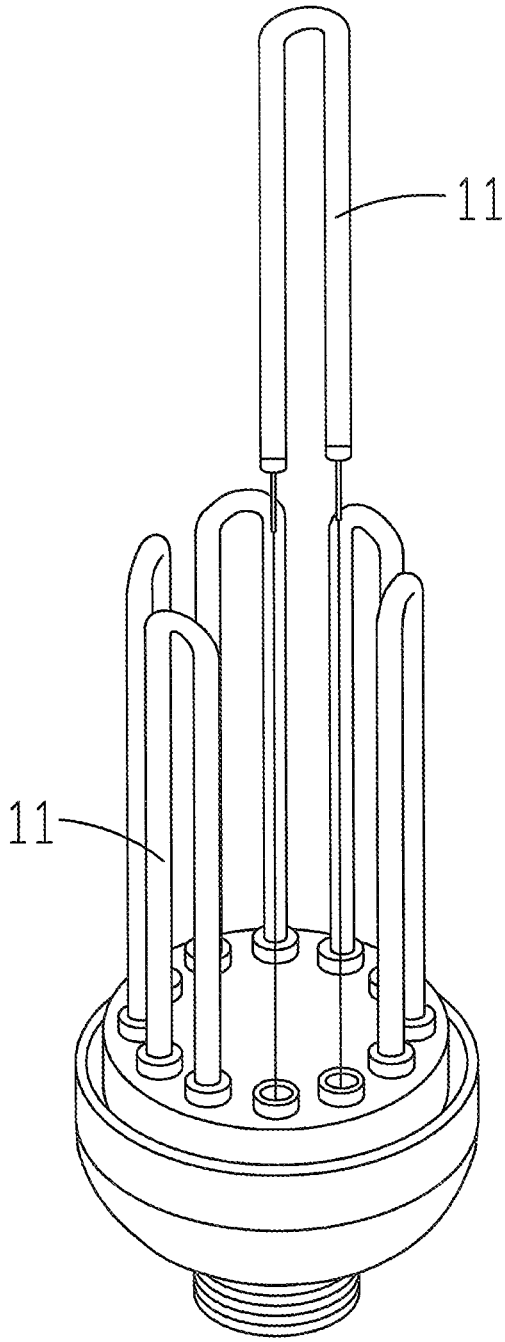
FIG.1 PRIOR ART
FIG. 1 is a perspective view of a first conventional cold cathode tube lamp having a plurality of U-shaped cold cathode tubes.
Figure 2:
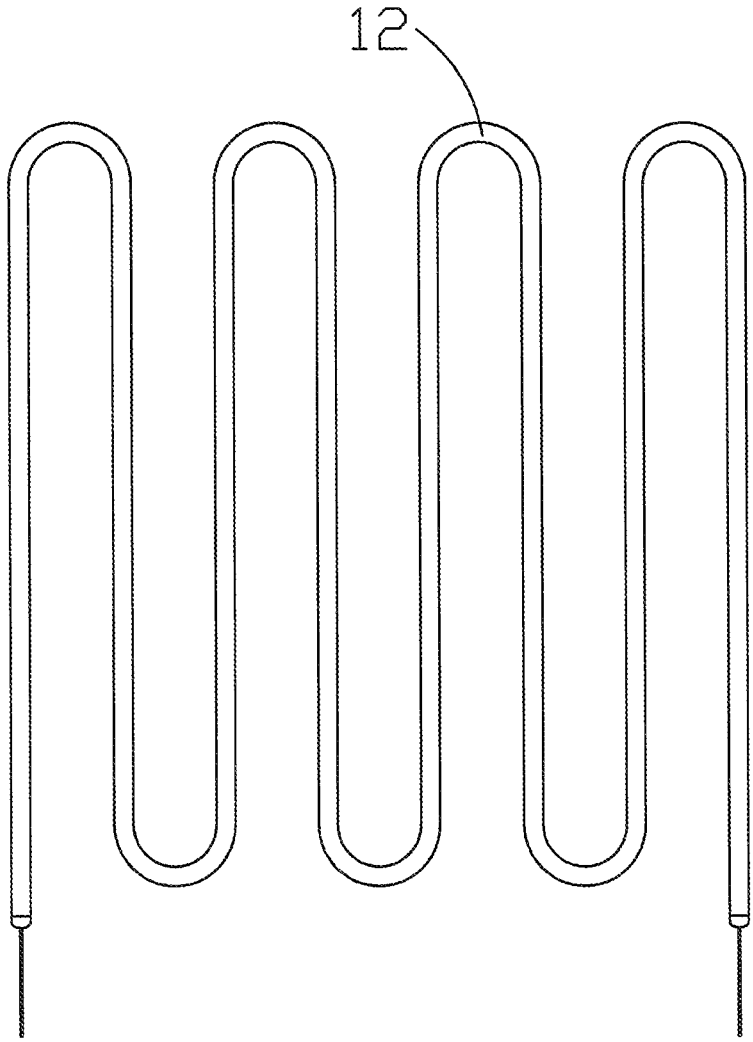
FIG.2 PRIOR ART
FIG. 2 is a schematic view of a second conventional cold cathode tube lamp having a plurality of continuous repeatedly-bent 2D cold cathode tubes.
Figure 3:
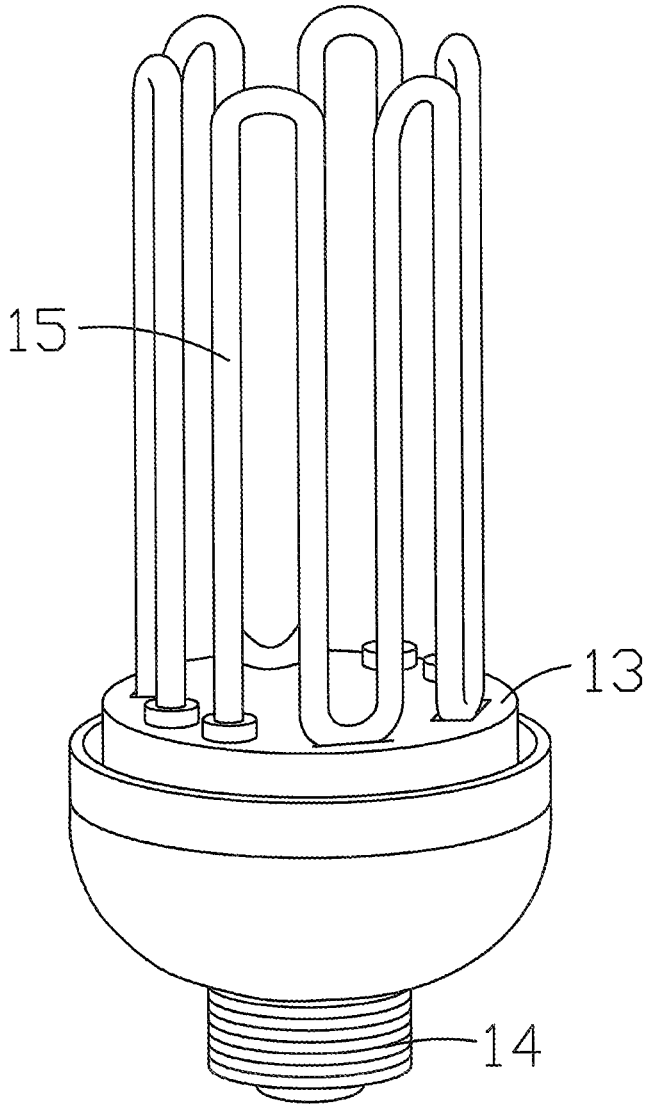
FIG.3 PRIOR ART
FIG. 3 is a schematic view of a third conventional cold cathode tube lamp having a plurality of continuous repeatedly-bent 3D cold cathode tubes.
Figure 4:
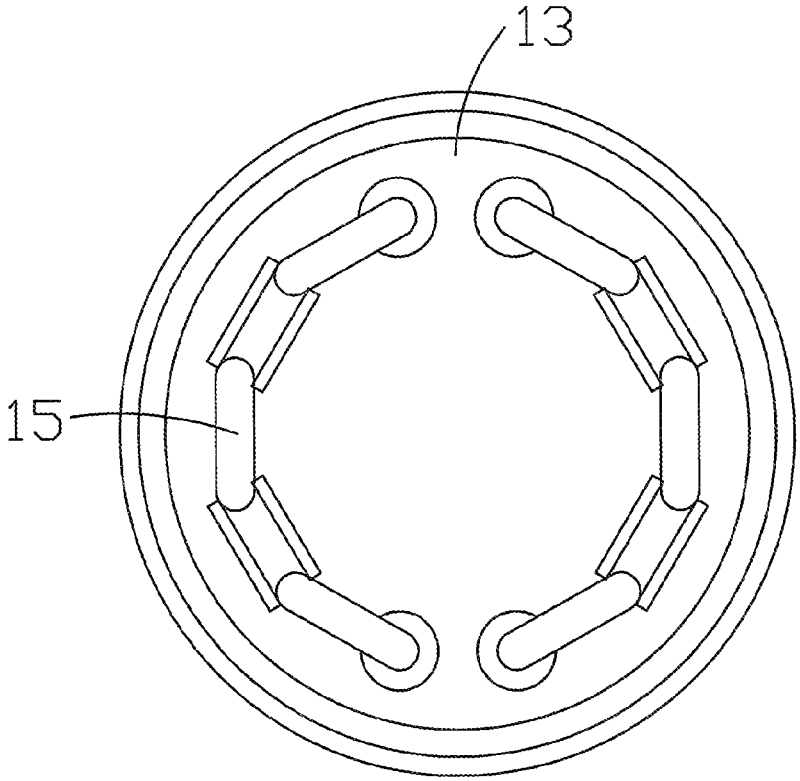
FIG.4 PRIOR ART
FIG. 4 is a schematic view of the structure of the third conventional lamp.
Figure 5:
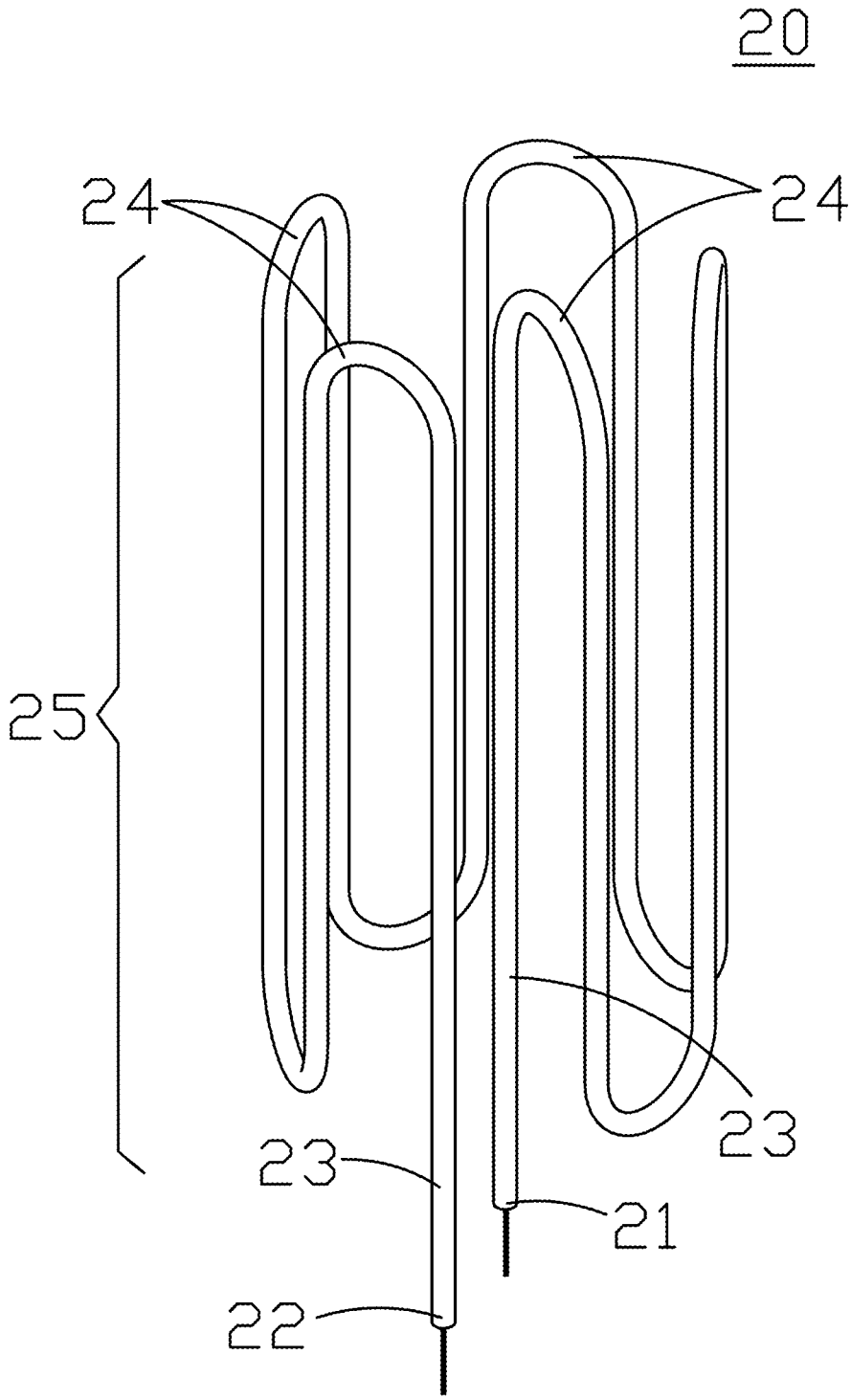
FIG. 5 is a perspective view of a 3D lamp tube in accordance with a first preferred embodiment of the present invention.
Figure 6:
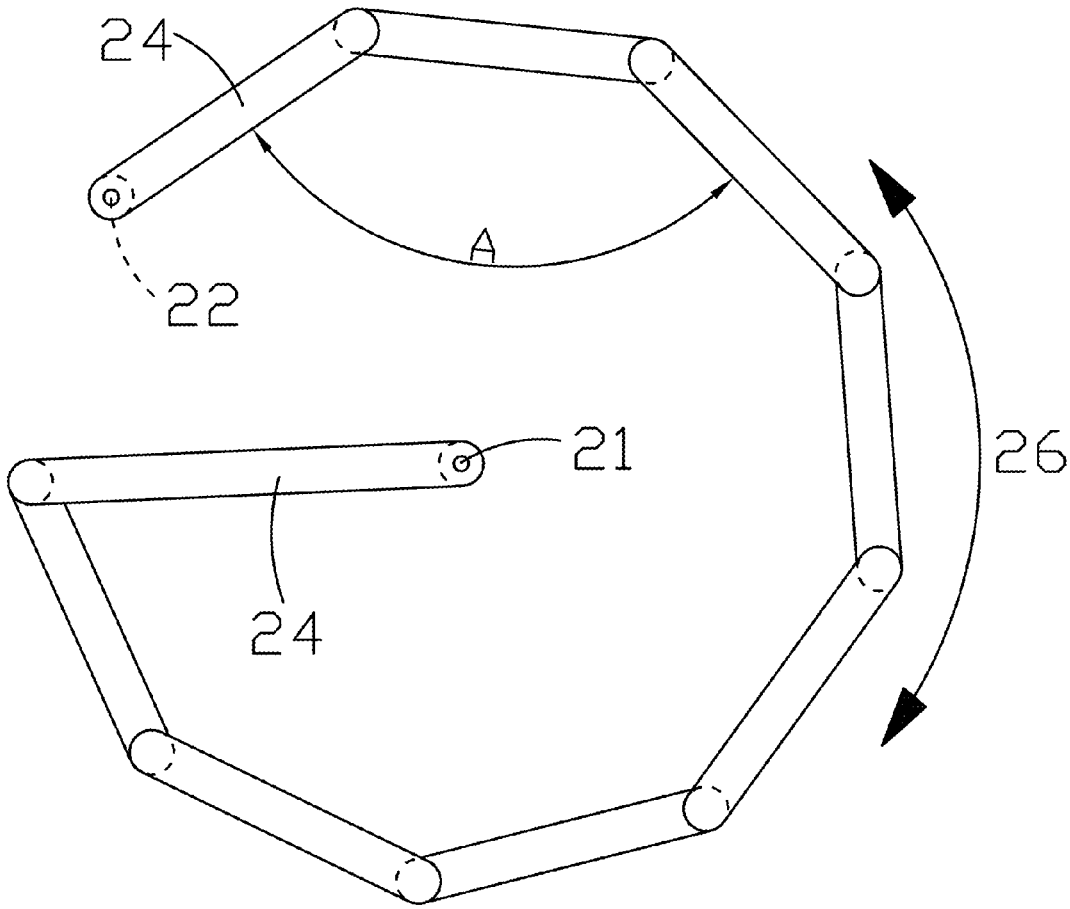
FIG. 6 is a schematic view of a 3D lamp tube of the present invention.

With reference to FIGS. 5 and 6 for a perspective view and a schematic view of a 3D lamp tube of the present invention respectively, the 3D lamp tube 20 comprises a first electrode terminal 21 and a second electrode terminal 22 disposed at both ends of the 3D lamp tube 20 respectively, a plurality of straight tube sections 23 disposed between the first and second electrode terminals 21, 22, and a bent section 24 disposed between two straight tube sections 23, wherein the first electrode terminal 21 is extended upwardly from one of the straight tube sections 23 and through the plurality of bent sections 24, and bent along the external periphery 25 of the first electrode terminal 21 into an arc 3D structure 26. In a preferred embodiment as shown in the figures, the straight tube section 23 at the top of the first electrode terminal 21 is bent from a bent section 24 and then extended downwardly from a straight tube section 23, and then bent from a bent section 24 and at the external periphery of the first electrode terminal 21 and sequentially and continuously bent from a plurality of straight tube sections 23 and a plurality of bent sections 24, and finally extended downwardly from another straight tube section 23 to the second electrode terminal 22.

Figure 7:
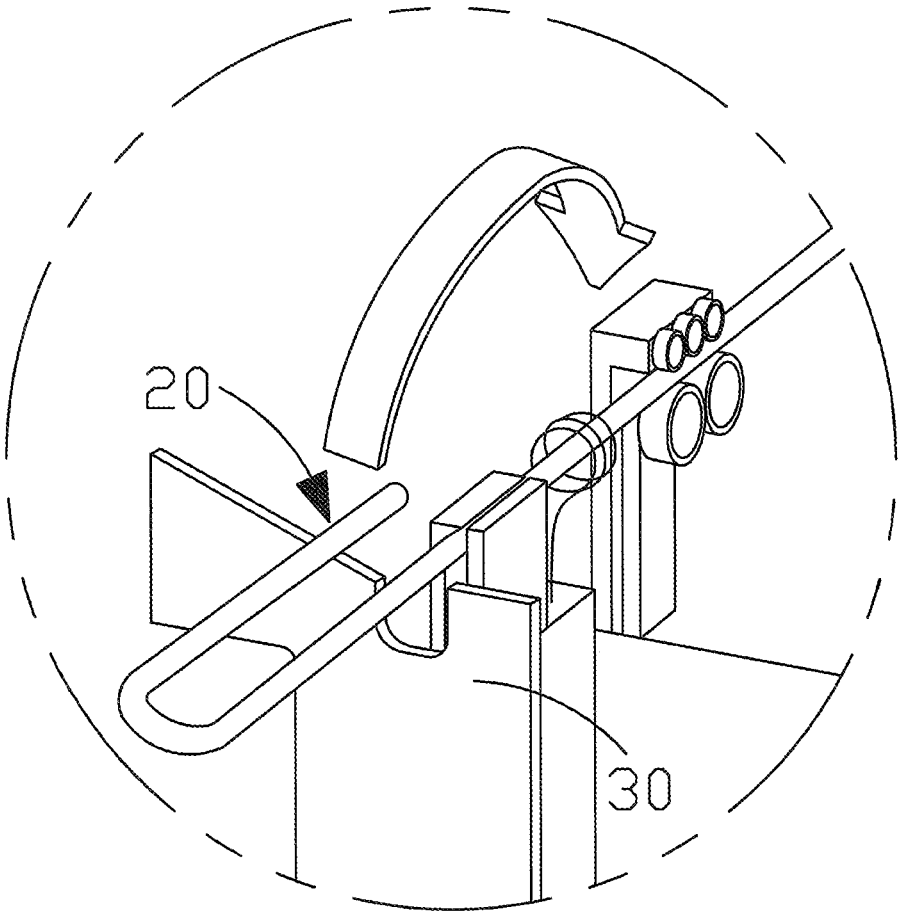
FIG. 7 is a schematic view of a 3D lamp tube that is bent and formed by a tool in accordance with the present invention.
Figure 8:
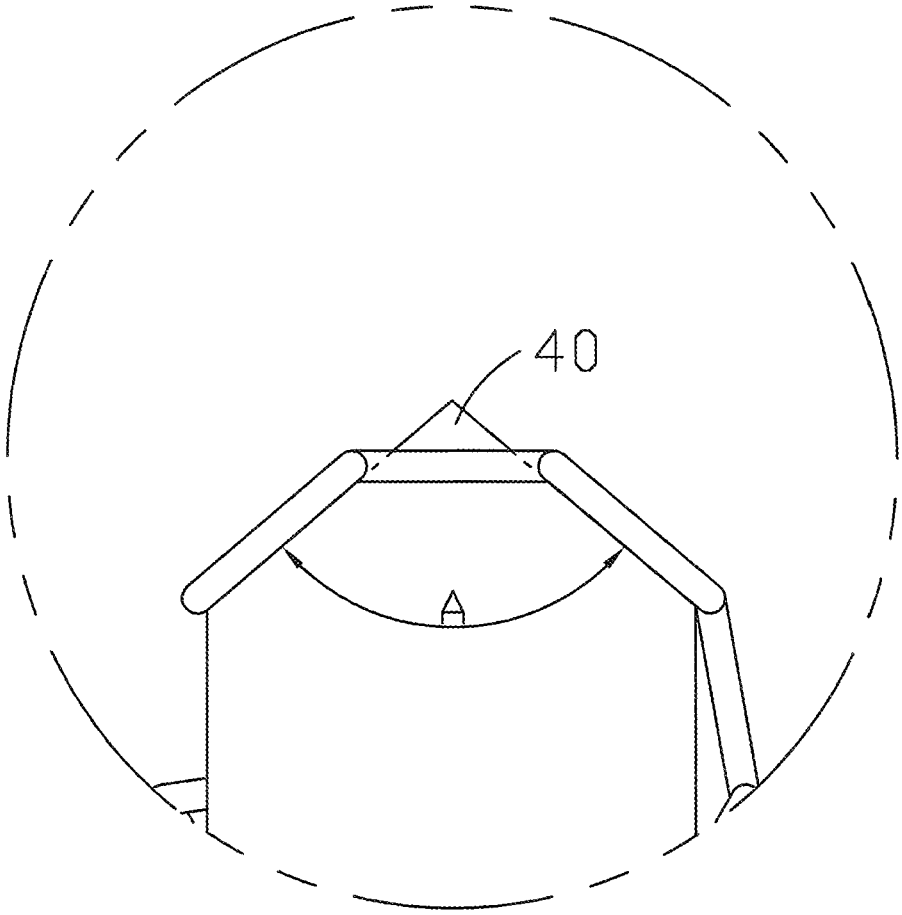
FIG. 8 is a schematic view of a 3D lamp tube that is bent by a tool with a different angle in accordance with the present invention.

During the overall formation, the 3D lamp tube 20 is bent at a high temperature by a tool 30 as shown in FIG. 7 to form a bent section 24. Of course, an angle tool 40 providing different angles as shown in FIG. 8 can be used for bending the 3D lamp tube in order to have different included angles between the bent sections 24.

Figure 9A:
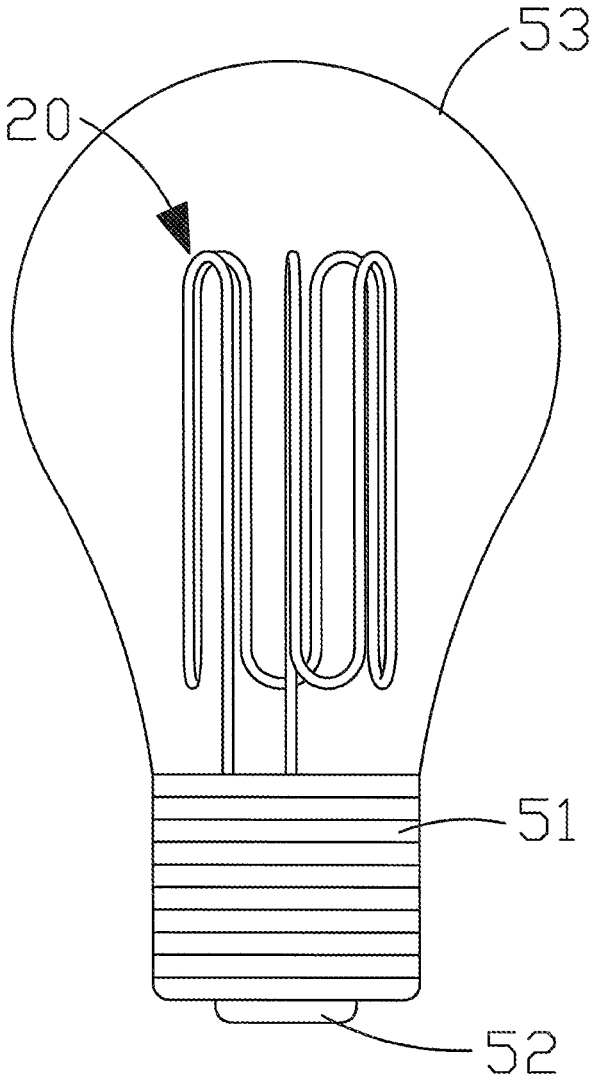
FIGS. 9(A) to 9(D) are perspective views of a 3D lamp tube of the present invention applied in different light bulbs respectively.
Figure 9B:
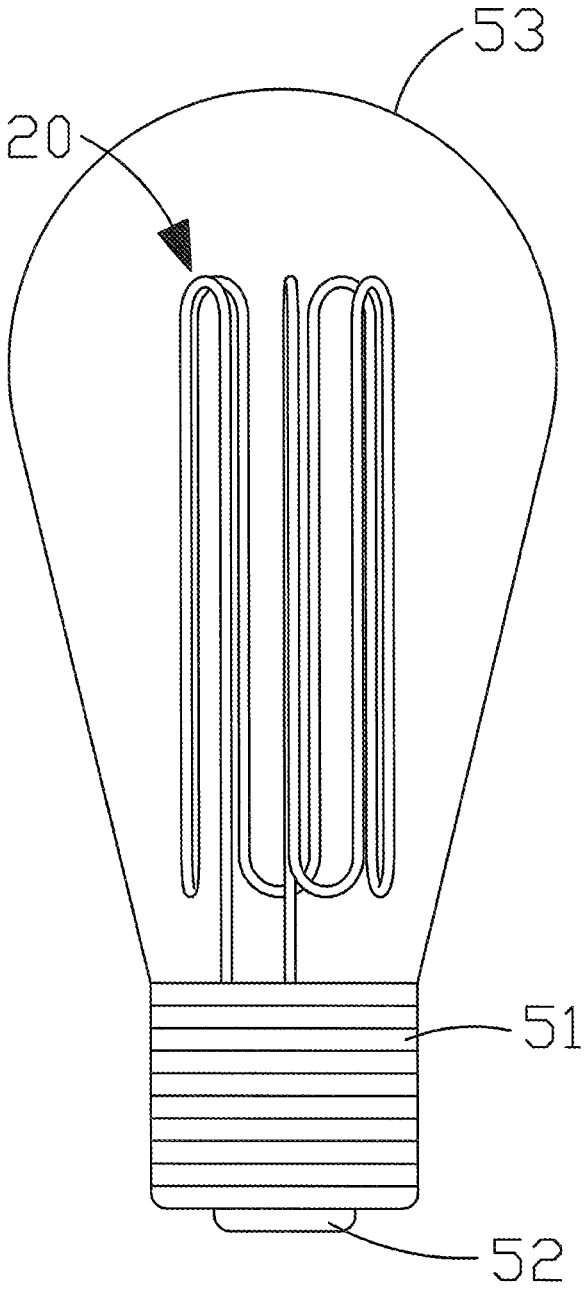
Figure 9C:
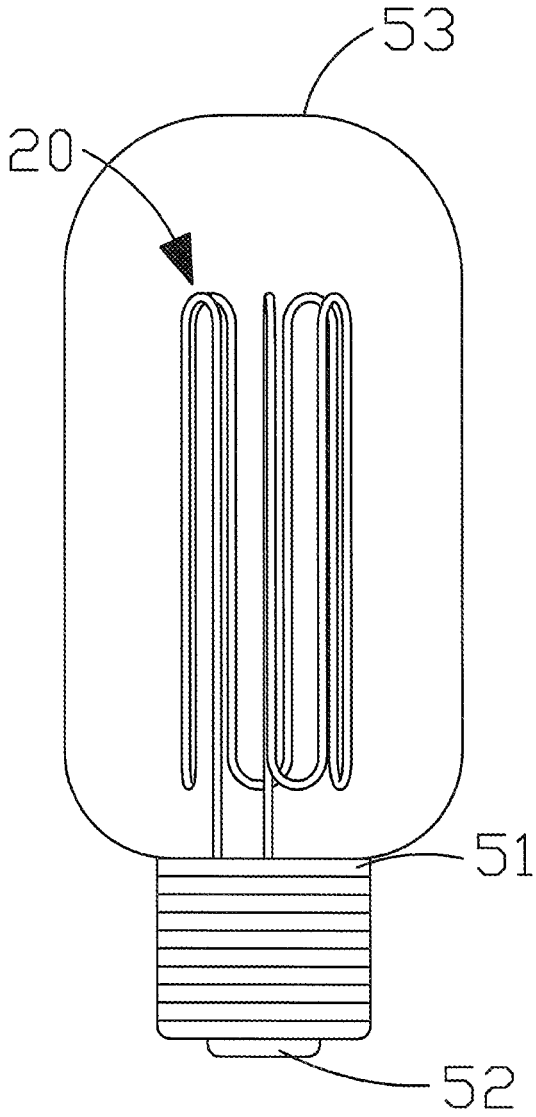
Figure 9D:
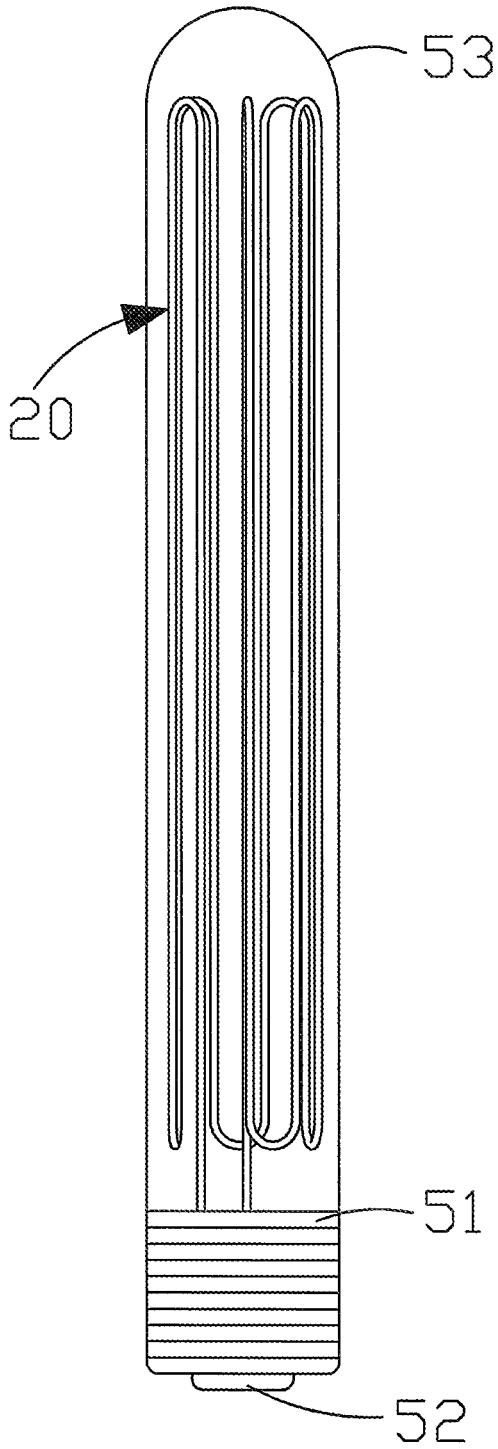

Wherein, the 3D lamp tube 20 of the present invention can be installed at a positioning base 51 coupled to a traditional lamp socket. In FIG. 9(A), the positioning base 51 includes a control circuit board (not shown in the figure) installed therein, and the control circuit board has a connector 52 coupled to the bottom of the positioning base and corresponding to the structure of the traditional lamp socket, and the control circuit board is electrically coupled to the first and second electrode terminals 21, 22 of the 3D lamp tube, and the positioning base 52 further includes a translucent cover 53 installed at the top of the positioning base 52 and covered onto the 3D lamp tube 20. Of course, the translucent cover 53 can be in a different shape as shown in FIGS. 9(B) to 9(D), and the 3D lamp tube 20 can have different shapes as well.

Compared with the prior art, the 3D lamp tube of the present invention has the following advantages:

1. The present invention provides a way of bending the 3D lamp tube at several positions by a high temperature, and the straight tube sections of the bent 3D lamp tube will not block one another, so as to maximize the light emission efficiency.

2. The present invention can concentrate the space and volume occupied by the 3D lamp tube to improve the drawback of the conventional lamp tube that can only be applied to a large planar lamp socket and to replace the conventional light bulb.

3. The present invention can replace the conventional light bulbs and the light of the straight tube section at the top of the first electrode terminal can supplement the light of other straight tube sections without producing a raster phenomenon.

4. The first electrode terminal is disposed at the center of the 3D lamp tube to facilitate the assembly of the 3D lamp tube of the present invention.

What is claimed is:

1. A three-dimensional (3D) lamp tube, comprising a first electrode terminal and a second electrode terminal formed at both ends of the 3D lamp tube respectively, and a plurality of straight tube sections disposed between the first and second electrode terminals, and a bent section being disposed between each two straight tube sections of the plurality of straight tube sections, wherein there are a plurality of bent sections, and the first electrode terminal being extended upwardly from one of the straight tube sections and through the plurality of bent sections, and bent along an external periphery of the first electrode terminal to produce an arc 3D structure, and finally extended downwardly from another straight tube section to the second electrode terminal, wherein the first electrode terminal does not contact the second electrode terminal.

2. The 3D lamp tube of claim 1, wherein the 3D lamp tube is installed at a positioning base coupled to a traditional lamp socket, and the positioning base has a control circuit board installed therein, and the control circuit board has a connector coupled to the bottom of the positioning base and corresponding to the structure of the traditional lamp socket, and the control circuit board is electrically coupled to the first and second electrode terminals of the 3D lamp tube.

3. The 3D lamp tube of claim 1, wherein the positioning base further includes a translucent cover installed to the top of the positioning base and covered onto the 3D lamp tube.

4. The 3D lamp tube of claim 1, wherein each bent section is bent and formed at the 3D lamp tube at a high temperature by using a tool.

* * * * *